US009425014B2

(12) United States Patent
Mills et al.

(10) Patent No.: US 9,425,014 B2
(45) Date of Patent: Aug. 23, 2016

(54) CIRCUIT INTERRUPTION DEVICE EMPLOYING SHAPE MEMORY ALLOY ELEMENT

(71) Applicant: Labinal, LLC, Denton, TX (US)

(72) Inventors: Patrick Wellington Mills, Bradenton, FL (US); James Michael McCormick, Bradenton, FL (US); David Michael Geier, Punta Gorda, FL (US)

(73) Assignee: LABINAL LLC, Denton, TX (US)

( * ) Notice: Subject to any disclaimer, the term of this patent is extended or adjusted under 35 U.S.C. 154(b) by 15 days.

(21) Appl. No.: 14/629,828

(22) Filed: Feb. 24, 2015

(65) Prior Publication Data

US 2015/0243463 A1 Aug. 27, 2015

Related U.S. Application Data

(60) Provisional application No. 61/944,654, filed on Feb. 26, 2014.

(51) Int. Cl.

| | |
|---|---|
| ***H01H 71/22*** | (2006.01) |
| ***H01H 61/00*** | (2006.01) |
| ***H01H 71/18*** | (2006.01) |
| ***H01H 61/06*** | (2006.01) |
| ***H01H 61/01*** | (2006.01) |
| ***H01H 71/14*** | (2006.01) |
| ***H01H 51/10*** | (2006.01) |

(52) U.S. Cl.
CPC ..... *H01H 61/0107* (2013.01); *H01H 51/10* (2013.01); *H01H 71/145* (2013.01)

(58) Field of Classification Search
CPC .. H01H 85/47; H01H 85/143; H01H 85/175; H01H 69/02
USPC ..... 337/123, 124, 125, 126, 137, 138, 139, 337/140, 141
See application file for complete search history.

(56) References Cited

U.S. PATENT DOCUMENTS

| | | | | |
|---|---|---|---|---|
| 4,490,975 A * | 1/1985 | Yaeger | H01H 61/0107 337/140 |
| 4,524,343 A | 6/1985 | Morgan | |
| 4,559,512 A * | 12/1985 | Yaeger | H01H 61/0107 337/140 |
| 4,713,643 A | 12/1987 | Baum | |
| 4,806,815 A * | 2/1989 | Honma | H01H 71/145 310/307 |

(Continued)

OTHER PUBLICATIONS

International Search Report filed in PCT/US2015/017241 mailed May 6, 2015.

*Primary Examiner* — Anthony Haughton
(74) *Attorney, Agent, or Firm* — Rankin, Hill & Clark LLP

(57) ABSTRACT

A circuit interruption device includes a support, a set of separable contacts, a first member movable between an OFF position and an ON position, a second member, and a transport mechanism that includes a shape memory alloy element. When the first member is in the OFF position, the second member is in an extended position, the shape memory alloy element is in its first shape, and the first surface and the another first surface are engaged with one another and resist movement of the first member away from the OFF position. Responsive to an electrical pulse, the shape memory alloy element transforms into its second shape and moves the first member toward the ON position. When the second member is in the extended position, the another second surface engages with the second surface to resist movement of the first member away from the ON position.

20 Claims, 3 Drawing Sheets

(56) References Cited

U.S. PATENT DOCUMENTS 4,884,780 A * 12/1989 Ohashi ..... F16K 31/025 165/42
4,885,560 A * 12/1989 Niino ..... H01H 37/002 337/140
5,563,390 A * 10/1996 Demissy ..... H01H 3/30 218/140
6,084,501 A * 7/2000 Plasko ..... H01H 37/323 337/140
6,133,816 A 10/2000 Barnes
6,972,659 B2 * 12/2005 von Behrens ..... E05B 47/0009 337/139
7,764,159 B2 * 7/2010 Zanella ..... E05B 47/0009 337/139
7,928,826 B1 4/2011 Woychik
2009/0302990 A1 12/2009 Nelly

* cited by examiner

CIRCUIT INTERRUPTION DEVICE EMPLOYING SHAPE MEMORY ALLOY ELEMENT

BACKGROUND

1. Field

The disclosed and claimed concept relates generally to electrical interruption equipment and, more particularly, to a circuit interruption device that employs a shape memory alloy element.

2. Related Art

Circuit interruption devices of many types are well understood in the relevant art. Among such well-known circuit interruption devices are circuit breakers, vacuum interrupters, ON/OFF switches, and the like without limitation. While circuit interruption devices have been generally effective for their intended purposes, they have not been without limitation.

Some applications require a circuit interruption device that is capable of operating in a high current environment, such as where current on the order of 400-500 Amperes is continuously fed. A circuit interruption device suited to such a circuit may potentially be difficult to move between ON and OFF positions. For this reason and for other reasons, such circuit interruption devices have thus sometimes employed devices such as solenoids and other such devices to switch the circuit interruption device to its OFF position in certain predefined circumstances. It is furthermore noted, however, that a solenoid that is suited to open the contacts of a circuit interruption device rated for 400-50 Amperes continuous feed can be bulky and heavy. Such bulk and weight are undesirable in certain applications, such as aerospace applications. It thus would be desired to provide an improved circuit interruption device.

SUMMARY

According to one aspect, a circuit interruption device includes a support, a set of separable contacts being movable between an OPEN condition and a CLOSED condition, and a first member situated on the support and being movable between an OFF position that corresponds with the OPEN condition and an ON position that corresponds with the CLOSED condition. The movable member is biased toward the first position and has a first surface and a second surface. The circuit interruption device also includes a second member situated on the support and that is movable between an extended position and a retracted position. The second member is biased toward the extended position and has another first surface and another second surface. The circuit interruption device also includes a transport mechanism which includes a shape memory alloy element that is transformable between a first shape and a different second shape responsive to an electrical pulse. In a first configuration of the circuit interruption device, the first member is in the OFF position, the second member is in the extended position, the shape memory alloy element is in its first shape, and the first surface and the another first surface are engaged with one another and are structured to resist movement of the first member away from the OFF position. Responsive to an electrical pulse, the shape memory alloy element is structured to transform into its second shape and to move the first member toward its ON position. In a second configuration of the circuit interruption device, the second member is in the extended position, and the another second surface is engageable with the second surface to resist movement of the first member away from the ON position.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
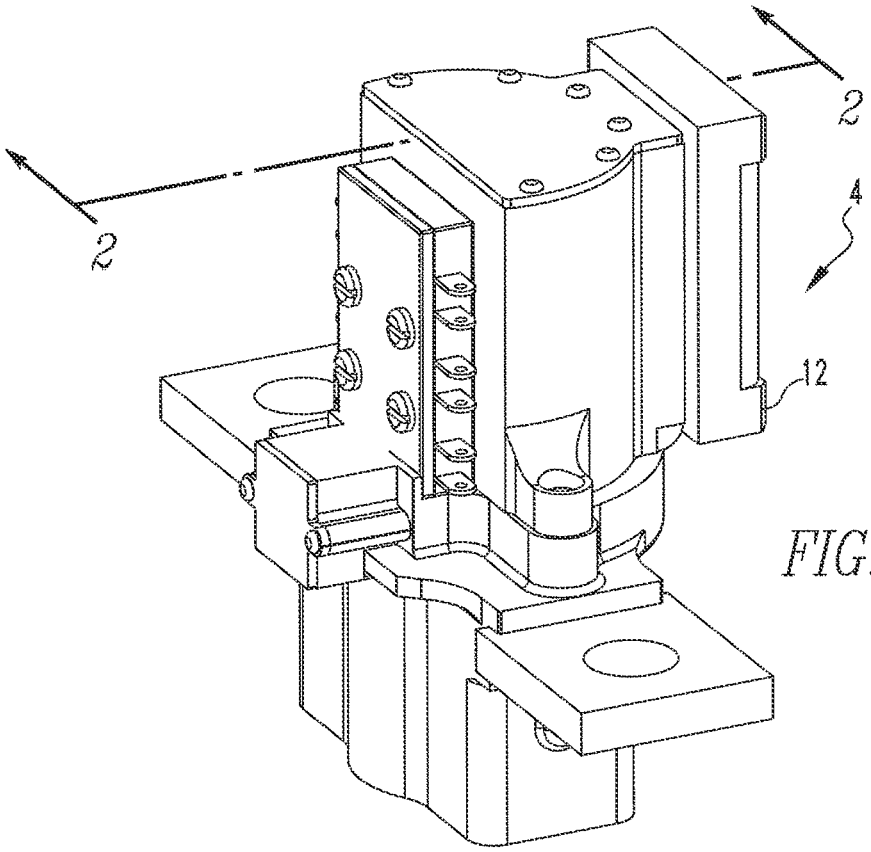
FIG. 1 is a perspective view of an improved circuit interruption device in accordance with the disclosed and claimed concept.
Figure 2:
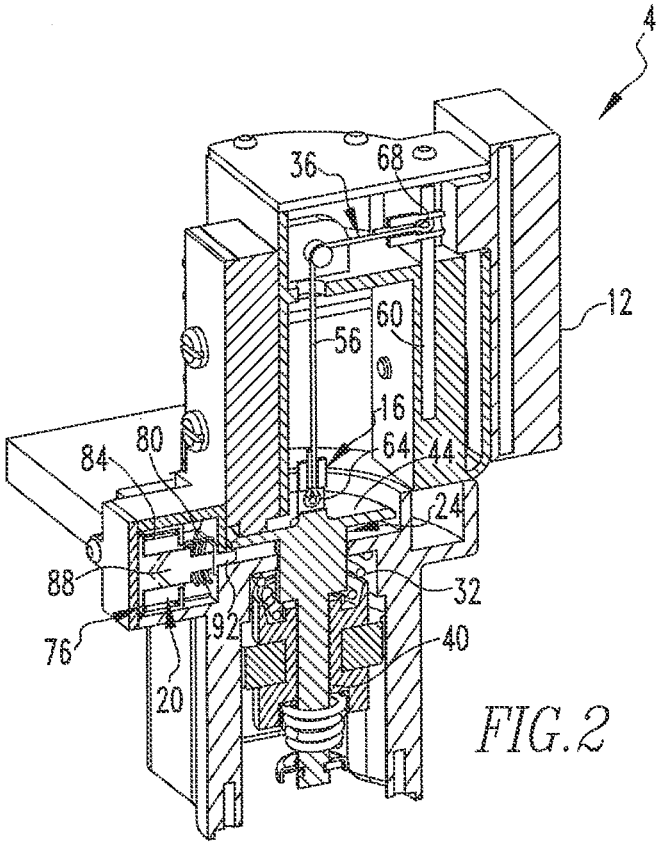
FIG. 2 is a perspective sectional view as taken along line 2-2 of FIG. 1.
Figure 5:
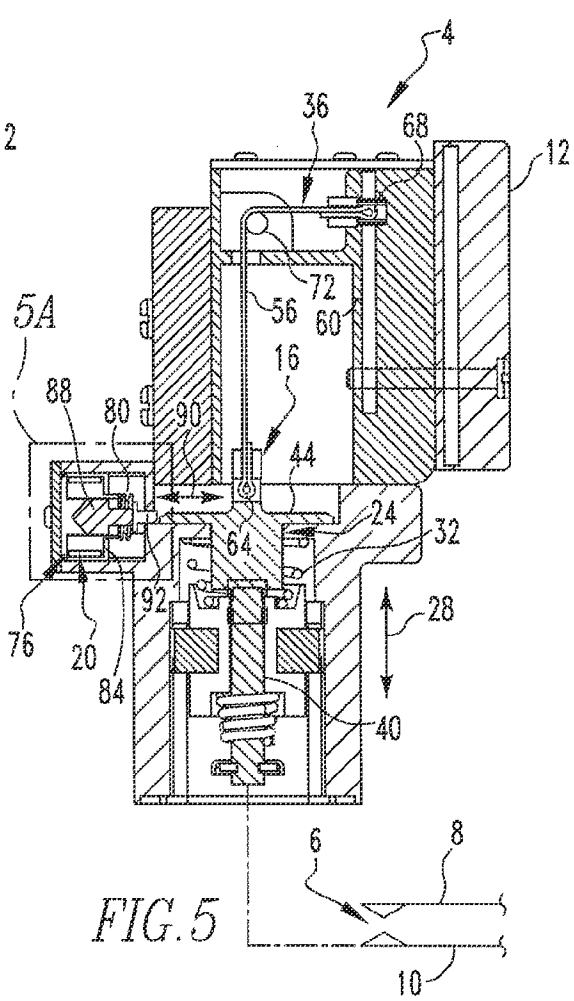
FIGS. 3-5 are elevational sectional views of the circuit interruption device of FIG. 1 as taken along line 2-2 of FIG. 1 with an operation apparatus and/or a latch apparatus thereof being in different relative positions.
Figure 4:
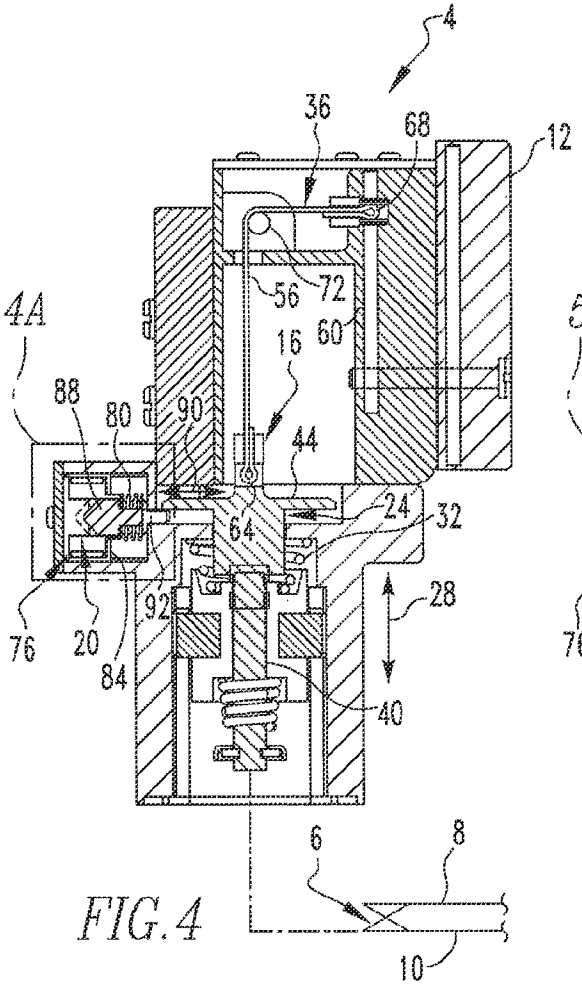
Figure 3:
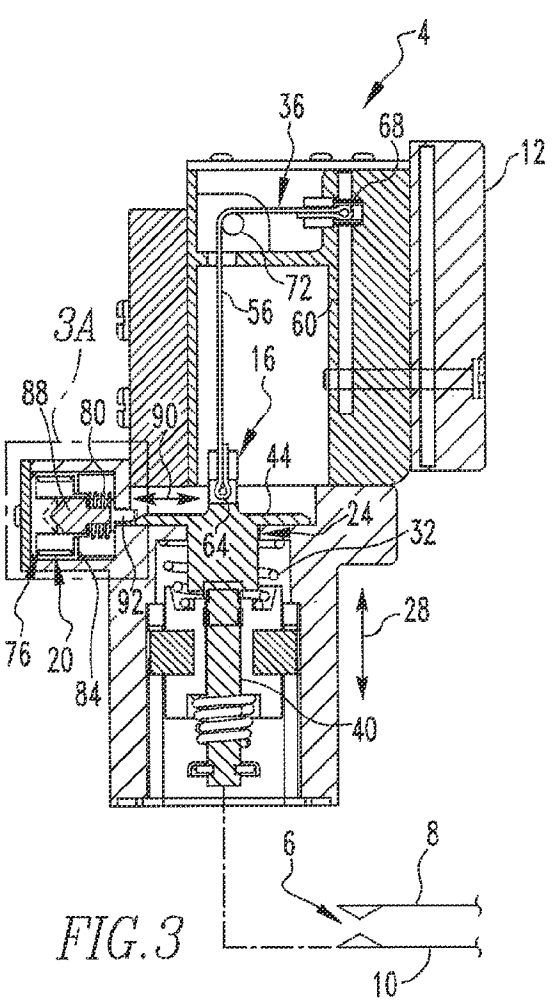

An improved circuit interruption device 4 is depicted generally in FIGS. 1-5A. As can be seen in FIGS. 3-5, the circuit interruption device 4 includes or is at least cooperably connected with a set of separable contacts 6 that are connected with a line conductor 8 and a load conductor 10. The circuit interruption device 4 is operable to move the set of separable contacts 6 between an OPEN condition that is depicted generally in FIGS. 3 and 5 and a CLOSED condition that is depicted generally in FIGS. 2 and 4. The circuit interruption device 4 is itself movable between an OFF position that is depicted generally in FIGS. 3 and 5 and an ON position that is depicted generally in FIGS. 2 and 4. The OFF position of the circuit interruption device 4 corresponds with the OPEN condition of the set of separable contacts 6, and the ON position of the circuit interruption device 4 corresponds with the CLOSED condition of the set of separable contacts 6. As is generally understood in the relevant art, the CLOSED condition of the set of separable contacts 6 causes the line and load conductors 8 and 10 to be electrical connected together.

The circuit interruption device 4 can be generally said to include a support 12 upon which are disposed an operation apparatus 16 and a latch apparatus 20. The operation apparatus 16 can be said to include an operating member 24 that is translatable along a first longitudinal direction 28 between an ON position that is depicted generally in FIGS. 2 and 4 and an OFF position that is depicted generally in FIGS. 3 and 5. Such movements of the operating member 24 between its ON and OFF positions serve to switch the circuit interruption device 4 between its ON and OFF positions.

The operation apparatus 16 can further be said to include a return spring 32 that biases the operating member 24 toward the OFF position and to further include a transport mechanism 36. As will be set forth in greater detail below, the transport mechanism 36 is operable to move the operating member 24 from the OFF position to the ON position responsive to an electrical pulse.

Figure 5A:
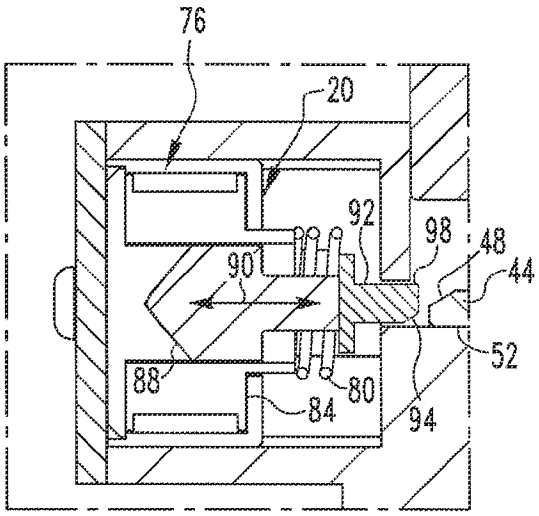
FIG. 5A is an enlarged view of the indicted portion of FIG. 5.
Figure 4A:
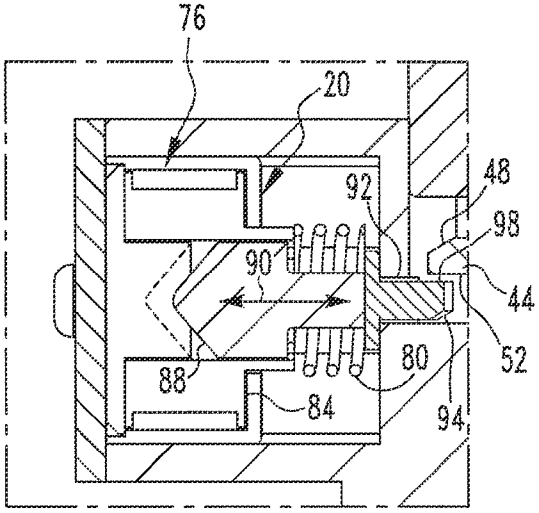
FIG. 4A is an enlarged view of the indicated portion of FIG. 4.
Figure 3A:
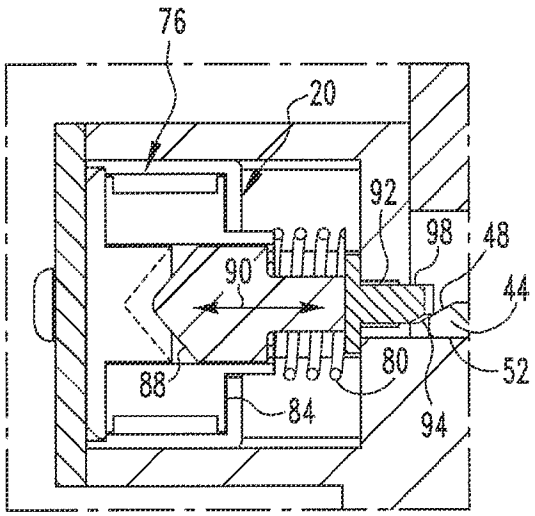
FIG. 3A is an enlarged view of the indicated portion of FIG. 3.

The operating member 24 can itself be said to include an elongated rod 40 that is operatively connected with a movable contact of the set of separable contacts 6 as is depicted generally in FIGS. 3-5. The operating member 24 further includes an annular flange 44 that protrudes outwardly from the rod 40 and which includes a ramped surface 48 and an abutment surface 52 that are best depicted in FIGS. 3A, 4A, and 5A. The ramped surface 48 is oriented generally oblique to the first longitudinal direction 28, and the abutment surface 52 is oriented generally perpendicular to the first longitudinal direction 28. As employed herein, the expression "oblique" shall refer generally to a relationship that is neither parallel nor perpendicular. The ramped and abutment surfaces 48 and 52 face generally away from one another.

The transport mechanism 36 can be stated to include a shape memory alloy element 56 and a heat sink 60, with the shape memory alloy element 56 having a connection 64 with the operating member 24, and with the shape memory alloy element 56 having another connection 68 with the heat sink 60. In the depicted exemplary embodiment, the shape memory alloy element 56 extends about a portion of a perimeter of a pin 72 that is mounted on the support 12. The heat sink 60 is itself mounted on the support 12 in the depicted exemplary embodiment.

The shape memory alloy element 56 is formed of a Single Crystal Shape Memory Alloy (SCSMA) that can be formed from a metallic alloy whose constituents may largely include copper-aluminum-nickel (Cu—Al—Ni) or other appropriate alloy. An SCSMA has various advantages over a conventional Shape Memory Alloy (SMA), and thus the shape memory alloy element 56 is desirably formed of an SCSMA. Advantages of an SCSMA include significantly greater strain recovery, 9% versus 3% for an SMA. Further advantages of an SCSMA over an SMA include true constant three deflection, and very narrow loading hysteresis and recovery which are generally 100% repeatable and complete. An SCSMA additionally has a transition temperature range that may be, for instance, in the range of −200° C. to +250° C., which is a greater transition range than a conventional SMA. Other advantages are known in the general art. It is also noted, however, that the shape memory alloy element 56 may be formed from an SMA depending upon the needs of the particular application.

As is generally understood in the art, a shape memory alloy material such as a conventional SMA or an improved SCSMA is typically formed to have some type of an original shape. The SMA or the SCSMA can thereafter be deformed by bending, stretching, and the like into any of a variety of shapes while it remains at a temperature that is less than its transition temperature. Upon heating the SMA or the SCSMA to its transition temperature, however, the shape memory alloy transforms from its deformed shape back into to its original shape. Upon cooling of the shape memory alloy below its transition temperature, it may return to the deformed shape.

Accordingly, the shape memory alloy element 56 employed herein is movable between an original shape and a deformed shape. The shape memory alloy element 56 returns to its original shape in response to heating, which is provided by an electrical pulse applied to the shape memory alloy element 56. More particularly, the shape memory alloy element 56 is, in the depicted exemplary embodiment, an elongated structure whose length changes when it moves between the deformed shape and the original shape. The original shape is of an elongated configuration and is of a relatively shorter length whereas the deformed shape is likewise of an elongated configuration but of a relatively longer length. When an electrical pulse is applied to the shape memory alloy element 56 and heats it above its transition temperature, the shape memory alloy element 56 shortens from its relatively longer deformed shape to its relatively shorter original shape. As will be set forth in greater detail below, such shrinking or reduction in the length of the shape memory alloy element 56 that is occasioned by the electrical pulse applied thereto causes the operating member 24 to be moved from its OFF position to its ON position.

In the depicted exemplary embodiment, the shape memory alloy element 56 is an elongated fiber formed of an SCSMA. When the shape memory alloy element 56 is heated by the aforementioned electrical pulse applied thereto, the length of the shape memory alloy element 56 shrinks by approximately 9%, which is a change in length that is sufficient to move the operating member 24 from its OFF position to its ON position, which will be described in greater detail below.

The exemplary heat sink 60 is formed from aluminum or other appropriate thermally conductive material and is configured to rapidly cool the shape memory alloy element 56 to a temperature below its transition temperature subsequent to the application of the electrical pulse. The heat sink 60 does so in a generally understood fashion by shunting heat away from the shape memory alloy element 56. The heat sink 60 is desirably configured to have a heat shunting capacity that is great enough to provide sufficient heat shunting to cool the shape memory alloy element 56 to a temperature below its transition temperature despite repeated operation of the circuit interruption device 4. That is, the heat sink 60 has a sufficient heat shunting capacity that it will continue to cool the shape memory alloy element 56 below its transition temperature in an environment of repeated applications of electrical pulses to the shape memory alloy element 56 and dissipation of the heat generated therefrom to the heat sink 60.

The latch apparatus 20 can be generally said to include a solenoid 76 and a biasing element 80 that are both situated on the support 12. The solenoid 76 is a miniature solenoid and includes an electrical coil 84 such as a close coil and plunger 88. The plunger 88 is movable along a second longitudinal direction 90 between an extended position as is depicted generally in FIGS. 2, 3, 3A, 4, and 4A and a retracted position as is depicted generally in FIGS. 5 and 5A. It is noted that FIGS. 2, 3, 3A, 4, and 4A further depict in phantom lines the plunger 88 in its retracted position in order to illustrate the distance of movement between the extended and retracted positions. In the depicted exemplary embodiment, the first and second longitudinal directions 28 and 90 are substantially orthogonal to one another although other positional relationships can be employed depending upon the needs of the particular application. In the depicted exemplary embodiment, the coil 84, when energized, causes the plunger 88 to move to its retracted position. The biasing element 80 biases the plunger 88 toward the extended position.

The plunger 88 can be said to include a latching element 92 at an end thereof that interacts with the flange 44 of the operating member 24. The latching element 92 includes an angled surface 94 and an engagement surface 98 that face generally away from one another. In the depicted exemplary embodiment, the angled surface 94 is oriented oblique to both the second longitudinal direction 90 and the first longitudinal direction 28. Further in the depicted exemplary embodiment, the exemplary engagement surface 98 is oriented substantially perpendicular to the first longitudinal direction 28 and generally parallel with the second longitudinal direction 90. It can be seen that the abutment surface 52 is likewise oriented.

The circuit interruption device 4 in FIG. 3 can be generally said to be in a first configuration which corresponds with the OFF position of the circuit interruption device 4. The circuit interruption device 4 in FIGS. 2 and 4 can be generally said to be a second configuration which corresponds generally with the ON position of the circuit interruption device 4. Furthermore, the circuit interruption device 4 is movable between the first and second configurations.

More particularly, and as can be generally understood from FIGS. 3 and 3A, when the circuit interruption device 4 is in the first configuration, the shape memory alloy element 56 is in its relatively longer deformed shape, the operating member 24 is in its OFF position, the set of separable contacts 6 are in their OPEN condition, and the plunger 88 is in its extended position due to the solenoid 76 being de-energized and also due to the biasing element 80 biasing the plunger 88 toward the extended position. In such a situation, the ramped surface 48 of the flange 44 and the angled surface 94 of the latching element 92 are engaged with one another. Such engagement of the ramped and angled surfaces 48 and 94 and the bias of the biasing element 80 to maintain such engagement helps to retain the operating member 24 in its OFF position despite vibration, acceleration, and the like. For the sake of completeness, it is reiterated that the return spring 32 biases the operating member 24 toward the OFF position, which further helps to retain the operating member 24 and the circuit interruption 4 in the OFF position. It thus can be understood that when the circuit interruption 4 is in its OFF position, the interaction between the latching element 92 and the flange 44 of the operating member 24 helps to retain the circuit interruption device 4 in its OFF position.

When it is desired to switch the circuit interruption device 4 from its OFF position to it ON position, an electrical pulse is applied to the shape memory alloy element 56 which, as set forth above, heats the shape memory alloy element 56 and causes it to transform from its relatively longer deformed shape to its relatively shorter original shape. Such shrinking or contraction or shape transformation by the shape memory alloy element 56, i.e., changing its length from the relatively longer length of the deformed shape to the relatively shorter length of the original shape, causes a tensile force to be applied to the operating member 24. Such tensile force is applied to the operating member 24 in the first longitudinal direction 28 and generally in the upward direction from the perspective of FIGS. 3 and 3A. The tensile force is of sufficient magnitude to overcome the bias of the return spring 32 and to further overcome the bias of the biasing element 80 by causing the ramped and angled surfaces 48 and 94 to slide along one another and to cause the plunger 88 to be moved from its extended position toward the retracted position. In addition to overcoming the bias of the biasing element 80 by such sliding movement between the ramped and angled surfaces 48 and 94, the tensile force from the shape memory alloy element 56 additionally overcomes static and dynamic friction between the ramped and angled surfaces 48 and 94.

As mentioned above, the length of the shape memory alloy element 56 shrinks by approximately 9% when the shape memory alloy element 56 is heated by the electrical pulse. In the depicted exemplary embodiment, the set of separable contacts 6 have a nominal arc gap of 0.038 inches in the OPEN condition. Moreover, the movable portion of the set of separable contacts 6 is additionally movable with respect to the operating member 24 along the first longitudinal direction 28 to provide for an over-travel and/or wear allowance. As such, the total exemplary movement of the operating member 24 along the first longitudinal direction 28 between the ON and OFF positions is 0.053 inches. Therefore, using wire that contacts 9% would require 0.589 inches of wire length to achieve the desired total movement. In the depicted exemplary embodiment, the wire that forms the shape memory alloy element 56 is of a diameter on the order of 0.020 inches. Multiple wires twined together can be used to increase force with the same total movement.

Once the tensile force applied by the shape memory alloy element 56 to the operating member 24 moves the plunger 88 sufficiently toward the retracted position that the ramped and angled surfaces 48 and 94 are no longer engaged with one another, i.e., they are disengaged, the contraction of the shape memory alloy element 56 and the resultant tensile force applied to the operating member 24 cause the operating member 24 to be translated along the first longitudinal direction 28 in the upward direction from the perspective of FIGS. 3 and 4 until the operating member 24 is in the ON position that is depicted generally in FIGS. 4 and 4A. In such a situation, the flange 44 has moved in the upward direction from the perspective of FIGS. 3-4A sufficiently that the flange 44 has cleared the latching element 92, and the biasing element 80 is thus able to move the plunger 88 and the latching element 92 thereon to the extended position that is depicted generally in FIGS. 4 and 4A. In such a condition, the engagement surface 98 of the latching element 92 is situated with respect to the abutment surface 52 such that the abutment and engagement surfaces 52 and 98 are engageable with one another and serve to resist the operating member 24 from moving away from the ON position to the OFF position.

It is particularly noted that FIG. 4A depicts the flange 44 in a condition wherein the shape memory alloy element 56 is in its relatively shorter original shape, such as during application of the electrical pulse or immediately thereafter and prior to the cooling of the shape memory alloy element 56 that is afforded by the heat sink 60. As such, the abutment surface 52 is depicted as being spaced slightly from the engagement surface 98. Upon cooling of the shape memory alloy element 56 below its transition temperature, the shape memory alloy element 56 will return toward its relatively longer deformed shape. This will permit the return spring 32 to bias the operating member 24 in the generally downward direction from the perspective of FIGS. 4 and 4A until the abutment surface 52 engages the engagement surface 98. In this condition, the operating member 24 and the circuit interruption device 4 remain in the ON position.

It thus can be understood that the electrical pulse which is applied to the shape memory alloy element 56 causes the shape memory alloy element 56 to transition from its deformed shape to its original shape and to thereby move the operating member 24 and the circuit interruption device 4 to the ON position. In such a position, the interaction between the flange 44 and the latching element 92 and, more particularly, the interaction between the abutment surface 52 and the engagement surface 98, assist in retaining the circuit interruption 4 in its ON position. This can be said to be a second configuration of the circuit interruption device 4. Advantageously, since the solenoid 76 is in its de-energized condition when the circuit interruption device 4 is in its ON position as is depicted generally in FIGS. 4 and 4A, the solenoid 76 itself consumes no power to maintain the circuit interruption device 4 in its ON position. Rather, the circuit interruption device 4 is retained in its ON position via interaction between the abutment and engagement surfaces 52 and 98 and with the solenoid 76 being in a no-load or de-energized condition, which advantageously saves electrical power.

When it is desired to move the circuit interruption device 4 from its ON position that is depicted generally in FIGS. 4 and 4A, the circuit interruption device 4 can be moved from its ON position to its OFF position by briefly energizing the coil 84 of the solenoid 76 to cause the plunger 88 to move from its extended position of FIGS. 4 and 4A to its retracted position of FIGS. 5 and 5A. Such movement of the plunger 88 to the retracted position of FIGS. 5 and 5A takes the engagement surface 98 out of the direction of travel of the flange 44 and its abutment surface 52 and thereby permits the return spring 32 to bias the operating member 24 to its OFF position. If, prior to the movement of the plunger 88 from the extended position to the retracted position the abutment and engagement surfaces 52 and 98 were engaged with one another, such as would occur if the shape memory alloy element 56 has cooled sufficiently to return it to its relatively longer deformed shape via shunting of heat therefrom by the heat sink 60, such movement by the plunger 88 to the retracted position will involve overcoming the static and dynamic friction between the abutment and engagement surfaces 52 and 98 and will cause the abutment and engagement surface 52 and 98 to become disengaged from one another.

It is understood that FIGS. 5 and 5A depict the circuit interruption device 4 in its OFF position while the solenoid 76 is energized and the plunger 88 is in its retracted position. When the coil 84 of the solenoid 76 is de-energized, the biasing element 80 will return the plunger 88 and its latching element 92 toward the extended position, which will cause the angled surface 94 to ride along and engage the abutment surface 52 as is depicted generally in FIGS. 3 and 3A, which place the circuit interruption device 4 back in its first configuration as described above.

It thus can be seen that the circuit interruption device 4 is movable from its OFF position to its ON position as a result of an electrical pulse applied to the shape memory alloy element 56. After application of such an electrical pulse to the shape memory alloy element 56, the latching element 92 and the flange 44 cooperate with one another to retain the operating member 24 and thus the circuit interruption device 4 in the ON position while the coil 84 of the solenoid 76 is in a no-load state. The circuit interruption device 4 in its ON position can then be returned to its OFF position by electrically pulsing or energizing the coil 84 of the solenoid 76, which causes the latching element 92 and the flange 44 to be removed from interaction with one another sufficiently that the return spring 32 can move the operating member 24 and thus the circuit interruption device 4 to the OFF position. Moreover, and as set forth above, when the coil 84 of the solenoid 76 is then de-energized, the biasing element 80 returns the latching element 92 into engagement with the flange 44 whereby such structures retain the circuit interruption device 4 in its OFF position, with the solenoid 76 again being in a no-load state. In such a position, the shape memory alloy element 56 is likewise in a no-load state.

While specific embodiments of the disclosed concept have been described in detail, it will be appreciated by those skilled in the an that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A circuit interruption device comprising:

a support;

a set of separable contacts being movable between an OPEN condition and a CLOSED condition;

a first member situated on the support and being movable between an OFF position that corresponds with the OPEN condition and an ON position that corresponds with the CLOSED condition, the movable member being biased toward the first position and having a first surface and a second surface;

a second member situated on the support and being movable between an extended position and a retracted position, the second member being biased toward the extended position and having another first surface and another second surface;

a transport mechanism comprising a shape memory alloy element that is transformable between a first shape and a different second shape responsive to an electrical pulse;

in a first configuration of the circuit interruption device, the first member is in the OFF position, the second member is in the extended position, the shape memory alloy element is in its first shape, and the first surface and the another first surface are engaged with one another and are structured to resist movement of the first member away from the OFF position;

responsive to an electrical pulse, the shape memory alloy element is structured to transform into its second shape and to move the first member toward its ON position;

in a second configuration of the circuit interruption device, the second member is in the extended position, and the another second surface is engageable with the second surface to resist movement of the first member away from the ON position.

2. The circuit interruption device of claim 1 wherein the transport mechanism further comprises a heat sink that is thermally conductively connected with the shape memory alloy element and which, subsequent to an electrical pulse, is structured to shunt away from the shape memory alloy element an amount of heat sufficient to cause the shape memory alloy element to be transformed from its second shape into its first shape.

3. The circuit interruption device of claim 2 wherein in a third configuration of the circuit interruption device, at least a portion of the amount of heat has been shunted from the shape memory alloy element, the second member is in the extended position, the second surface and the another second surface are engaged with one another to resist movement of the first member away from the ON position.

4. The circuit interruption device of claim 3 wherein, in the third configuration, the second member is movable toward the retracted position to cause the second surface and the another second surface to become disengaged from one another and to enable the bias of the first member to move the first member toward the OFF position.

5. The circuit interruption device of claim 4 wherein the circuit interruption device comprises a solenoid of which the second member is a part and which, when energized, moves the second member from the extended position toward the retracted position.

6. The circuit interruption device of claim 4 wherein the second member returned from the retracted position to the extended position due to the bias of the second member is engaged with the first member.

7. The circuit interruption device of claim 4 wherein the circuit interruption device is in its first configuration when the bias of the second member returns the second member from the retracted position to the extended position.

8. The circuit interruption device of claim 1 wherein the first member is translatable along a first longitudinal direction between the OFF and ON positions, and wherein the second member is translatable along a second longitudinal direction between the extended and retracted positions, the first and second longitudinal directions being substantially orthogonal to one another.

9. The circuit interruption device of claim 8 wherein at least one of the first surface and the another first surface is of a ramped shape oriented generally oblique to the first and second longitudinal directions.

10. The circuit interruption device of claim 9 wherein at least one of the second surface and the another second surface is oriented generally orthogonal to the first longitudinal direction and is oriented generally parallel with the second longitudinal direction.

11. The circuit interruption device of claim 9 wherein the at least one of the first surface and the another first surface that is of the ramped shape is oriented generally oblique to at least one of the second surface and the another second surface.

12. The circuit interruption device of claim 1 wherein the shape memory alloy element moving toward its second shape is structured to apply to the first member a closing force sufficient to overcome the bias of the second member and to overcome friction between the first surface and the another first surface to cause the first surface and the another first surface to move with respect to one another and to become disengaged from one another.

13. The circuit interruption device of claim 12 wherein the closing force is sufficient to additionally overcome the bias of the first member.

14. The circuit interruption device of claim 12 wherein the shape memory alloy element and the first member are connected together.

15. The circuit interruption device of claim 14 wherein the shape memory alloy element extends between the first member and the support.

16. The circuit interruption device of claim 1 wherein the circuit interruption device comprises a solenoid of which the second member is a part and which, when energized, moves the second member from the extended position toward the retracted position to permit the bias of the first member to move the first member away from the ON position and toward the OFF position.

17. The circuit interruption device of claim 1 wherein the second surface and the another second surface being engaged with one another are structured to resist movement of the first member away from the ON position.

18. The circuit interruption device of claim 17 wherein the first surface and the second surface face generally away from one another.

19. The circuit interruption device of claim 17 wherein the another first surface and the another second surface face generally away from one another.

20. The circuit interruption device of claim 1 wherein at least one of:

the first surface and the second surface are oriented oblique to one another; and the another first surface and the another second surface are oriented to one another.

* * * * *